US005082261A

United States Patent [19]

Pelfrey

[11] Patent Number: 5,082,261

[45] Date of Patent: Jan. 21, 1992

[54] BASKETBALL STAND

[75] Inventor: Keith A. Pelfrey, Wadsworth, Ohio

[73] Assignee: The Little Tikes Company, Hudson, Ohio

[21] Appl. No.: 270,782

[22] Filed: Nov. 14, 1988

[51] Int. Cl.[5] ..... A63B 63/08

[52] U.S. Cl. ..... 273/1.5 R; 248/407

[58] Field of Search ..... 273/1.5 R A; 248/407

[56] References Cited

U.S. PATENT DOCUMENTS

| | | | |
|---|---|---|---|
| 5,094 | 10/1872 | Mathewson | 248/407 X |
| D. 264,740 | 6/1982 | Merino et al. . | |
| 1,043,387 | 11/1912 | Astruck . | |
| 1,270,004 | 6/1918 | Chappell . | |
| 1,631,122 | 6/1927 | See . | |
| 2,818,254 | 12/1957 | Dunn . | |
| 2,916,184 | 12/1959 | Hartley et al. . | |
| 3,092,387 | 6/1963 | Wagner | 273/1.5 R X |
| 3,592,470 | 7/1971 | Breslow | 273/1.5 R X |
| 3,716,234 | 2/1973 | Lancelotti . | |
| 3,900,194 | 8/1975 | Ward et al. . | |
| 3,908,992 | 9/1975 | Cunningham et al. . | |
| 4,145,044 | 3/1979 | Wilson et al. . | |
| 4,285,518 | 8/1981 | Pearo | 273/1.5 R |
| 4,339,104 | 7/1982 | Weidman | 248/407 |
| 4,613,136 | 9/1986 | Raba et al. . | |
| 4,793,611 | 12/1988 | Thornell | 273/1.5 R |

FOREIGN PATENT DOCUMENTS 605246 2/1926 France .

OTHER PUBLICATIONS

Catalog Page, Huffy Basketball, Frabill Sporting Goods Division, 2018 South First Street, P.O. Box 07493, Milwaukee, WI 53207. Publication date 1982.

Pp. 6, 7, and 9, Today's Kids, Route 10 East, Booneville, AR 72927. Publication date 1987.

*Primary Examiner*—Paul E. Shapiro

*Attorney, Agent, or Firm*—Richard B. O'Planick

[57] ABSTRACT

A basketball assembly comprising a base (4), a lower post (6) attached at a lower end to the base and having an axial bore (41) extending downwardly therein from an upper end, an upper post (10) receivable in the lower post bore and extending upwardly therefrom, a backboard member (12) having a transverse slot (80) extending therethrough, and a hoop member (14) assembled over the top of the post (10) after insertion through the slot (80) in the backboard member (12). The upper post (10) is longitudinally repositionable within the axial bore (41), and a latching mechanism (52) is provided to engage detents (66) located in the upper posts (10), whereby securing the post (10) at a desired height.

10 Claims, 7 Drawing Sheets 80
74
12
14
78
72
70
76
46
8
45
48
44
52
38
60
38
36
62
41
40
64
16
66
42
10
30
6
66
32
66
28
22
20
4
34
24
68
18

BASKETBALL STAND

BACKGROUND OF THE INVENTION

1. Field of the Invention

This invention relates generally to basketball stands, and in particular to a basketball stand for young children which is marketed and sold in disassembled condition as a toy, and later assembled by the end user for use.

2. The Prior Art

Toy basketball stands are popular items for young children. Typically, such stands comprise a relatively light base pedestal, to which a metal pole is attached. A wood or particle board backboard and metal hoop assembly is provided to be connected typically together by screws during assembly. The pole is often provided with assembly apertures spaced vertically therealong at differing heights, and the backboard is alternatively and adjustably attached to the pole at such locations by metal screws, in order to enable the user to alter the height of the backboard assembly. The backboard assembly thereby supports, in cantilever fashion, the hoop member which extends therefrom at right angles and to which a suspended basketball net is attached.

While the above described available basketball stands are widely accepted and have enjoyed success in the industry, they are deficient in certain important respects. First of all, such stands require an elaborate assembly procedure, and assembly tools. Further, such stands are of relatively light construction; therefore, they often tip during use in reaction to a thrown basketball. Further, such stands are labor intensive in assembly, are expensive, and contain multiple parts, including fasteners which are susceptible to being lost.

The subject invention overcomes the above described shortcomings of currently available basketball stands by providing a stand composed entirely of economical and safe plastic construction, and which can be assembled without tools. The stand comprises a base pedestal and a first post member. The first post member has integral detent lugs snapping into detents within the base pedestal, and a latching, pivotal member attached to an upper end. The base pedestal is structured as a rotationally molded plastic body into which sand can be added as a ballast, adding stability and firmly anchoring the stand during play.

The subject invention further comprises an upper pole member which is inserted in telescopic fashion into an axial bore through the lower pole member. The upper pole has a series of spaced detents which are engaged by the latch member mounted to the lower pole, whereby permitting the upper pole to be adjusted in height relative to the base. The latching member is manually actuated, and is assembled to the lower pole without the need for attachment fasteners or assembly tools.

Further provided in the subject assembly is a backboard assembly comprising a backboard member having a horizontal rectilinear slot extending therethrough, and a hoop frame. The hoop frame comprises a circular frame portion, and a rectilinear neck portion which extends through the slot in the backboard and over a top end of the upper pole member. Accordingly, the backboard and hoop frame are fixedly and securely attached to the upper pole member whereby completing the assembly of the stand. Thereafter, relative height adjustment of the hoop frame can be made by telescopic adjustment of the upper pole relative to the lower pole member.

Accordingly, it is an objective of the subject invention to provide a basketball stand having integral height adjustment and locking mechanisms.

A further objective is to provide a basketball stand capable of assembly without the use of tools.

Yet a further objective of the subject invention is to provide a basketball stand which is capable of fastener-free assembly.

A further objective is to provide a basketball stand which provides counter-balancing ballast means, whereby the stand being rigidly secure in an upright condition during use.

Yet a further objective is to provide a basketball stand having a minimal number of component parts which can be compactly packaged and shipped.

A still further object of the present invention is to provide a basketball stand which is readily manufactured, and which is easily assembled and used.

These and other objectives, which will be apparent to one skilled in the art, are achieved by a preferred embodiment which is described in detail below and which is illustrated by the accompaning drawings.

BRIEF DESCRIPTION OF THE ACCOMPANING DRAWINGS

Figure 5A:
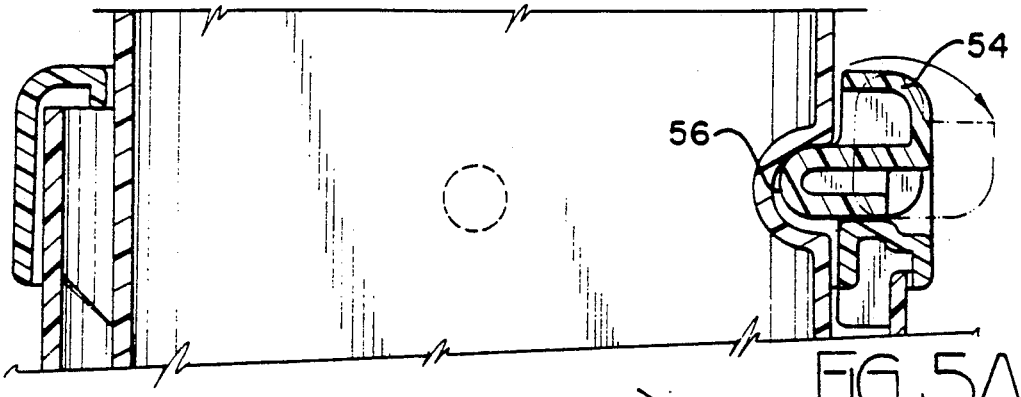
FIG. 5 is an exploded perspective view of the height adjustment latching mechanism which is assembled to the top of the lower post member.
Figures 6, 6A:
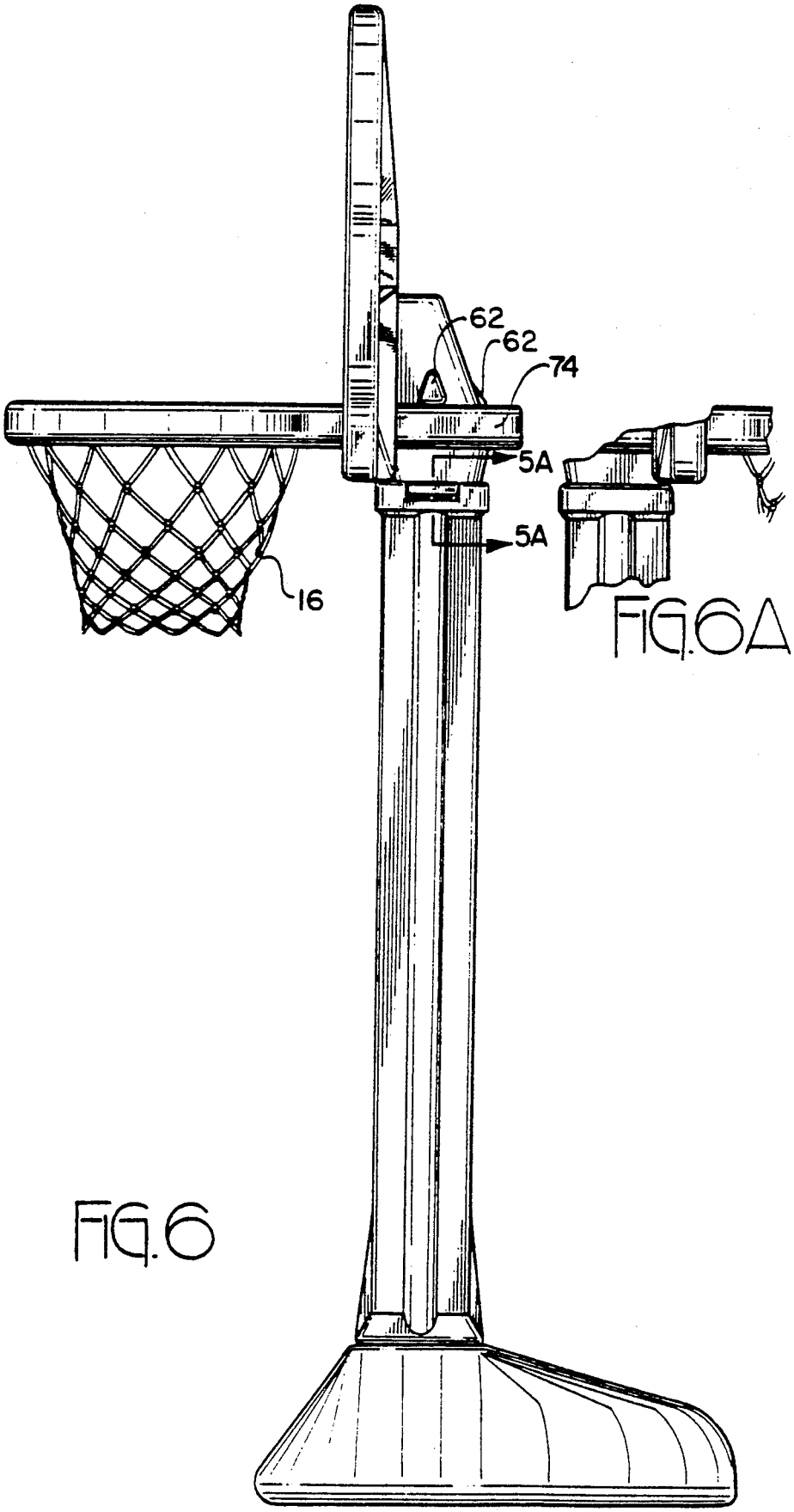

FIG. 5*a* is a sectional view through the latching mechanism of the subject basketball stand, taken along the line 5*a*—5*a* of FIG. 6.

FIG. 6 is a right side elevation view of the assembled basketball stand.

FIG. 6*a* is a partial left side view, illustrating in enlarged detail the connection between the hoop frame member, backboard, and the upper post member.

Figure 7:
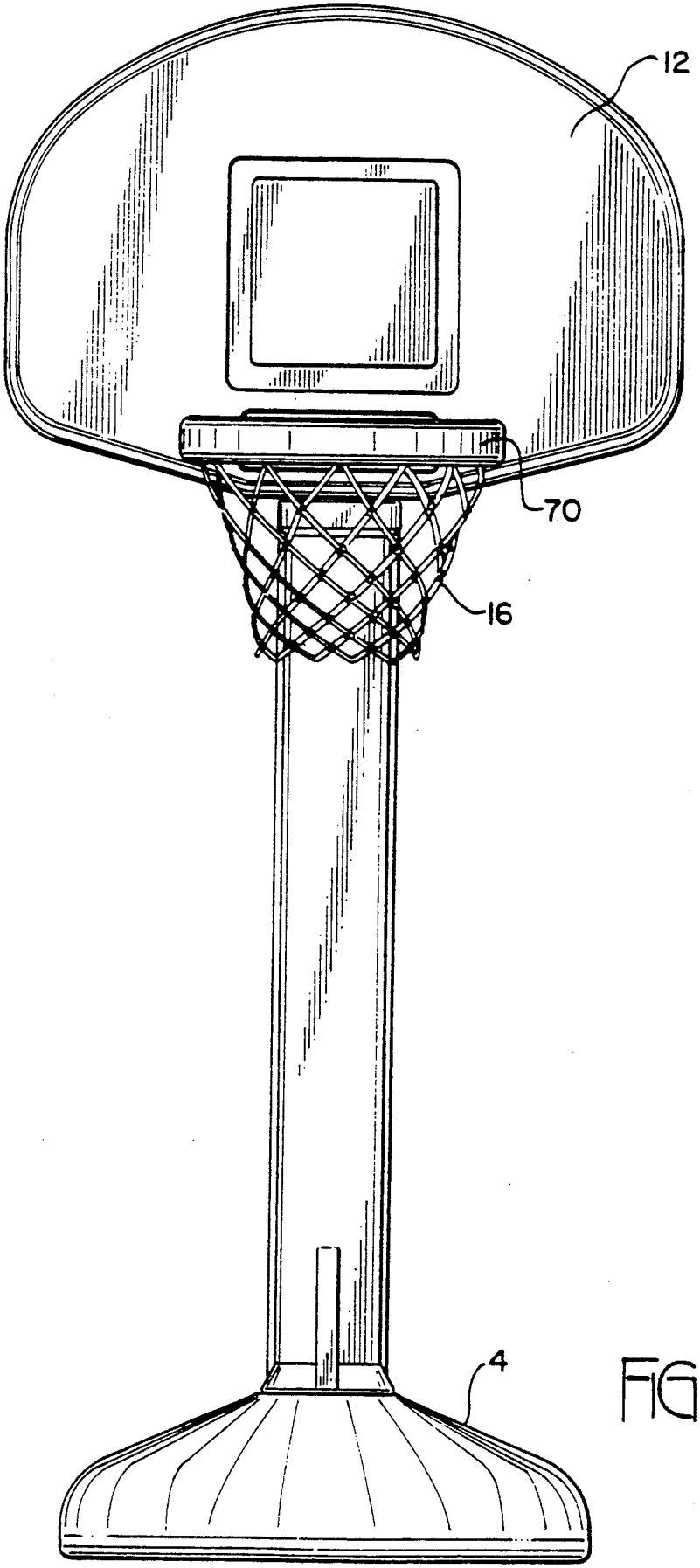

FIG. 7 is a front elevation view of the subject basketball stand as assembled.

Figure 8:
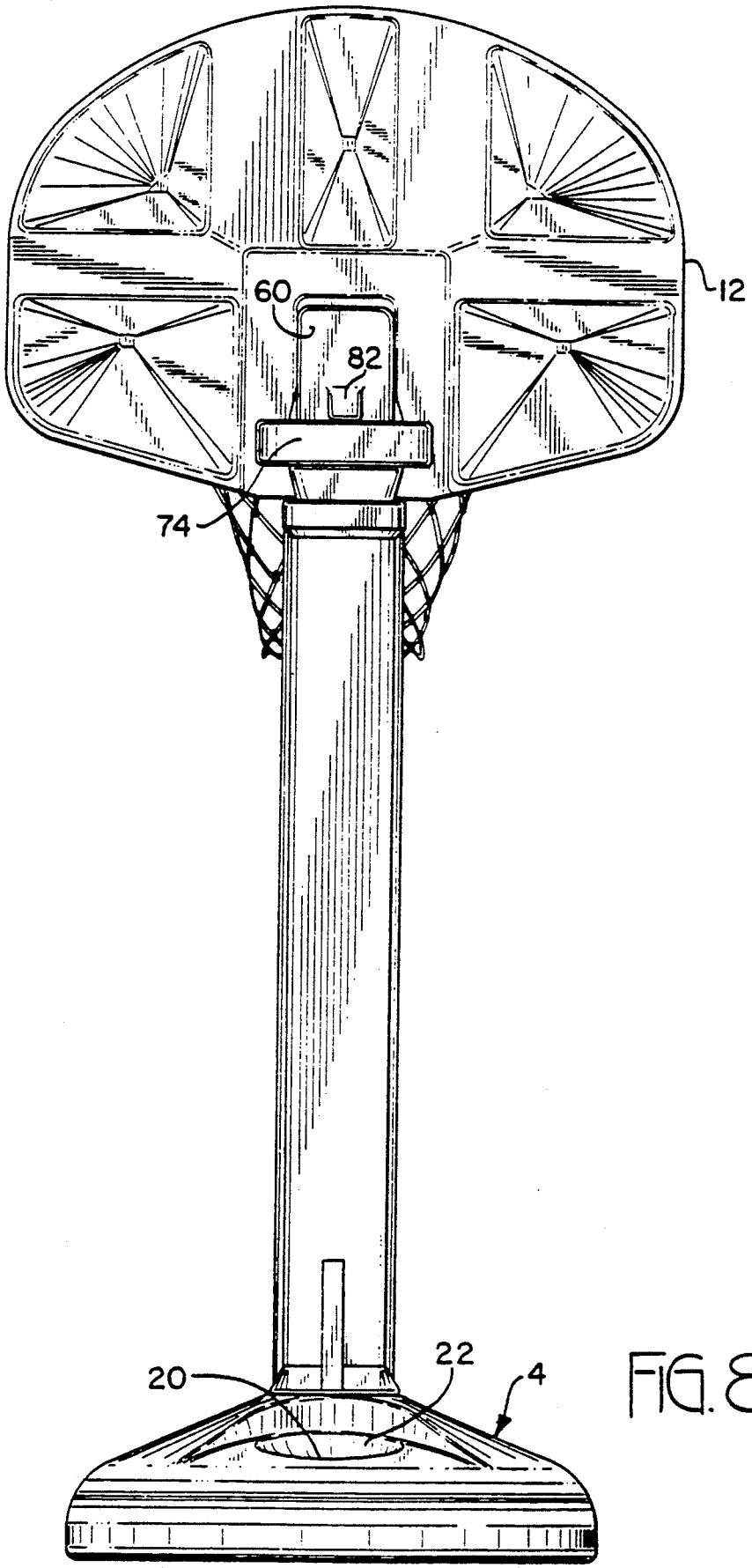

FIG. 8 is a rear elevation view of the assembled basketball stand.

DETAILED DESCRIPTION OF THE PREFERRED EMBODIMENT

Figure 1:
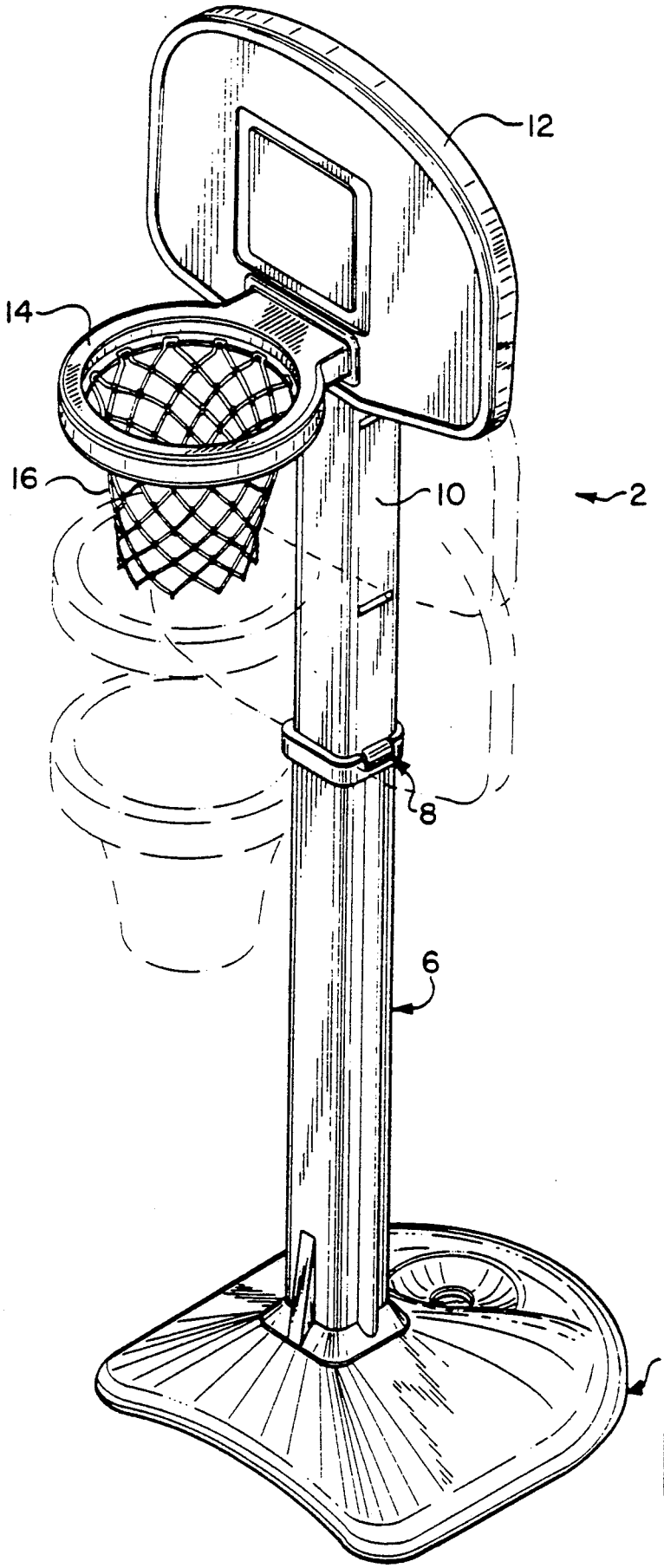
FIG. 1 is an assembled perspective view of the subject basketball stand, illustrating the height adjustment facility of the backboard assembly relative to the base of the stand.

Referring first to FIG. 1, the subject basketball stand (2) is shown as comprising a base (4), a lower post member (6), a pivot latch assembly (8), an upper post (10), a backboard (12), and a hoop component (14) from which a net (16) is suspended. The stand, as depicted in FIG. 1, is of a type typically sold through retail stores in a packaged, disassembled condition for later assembly by the end user.

Figure 2:
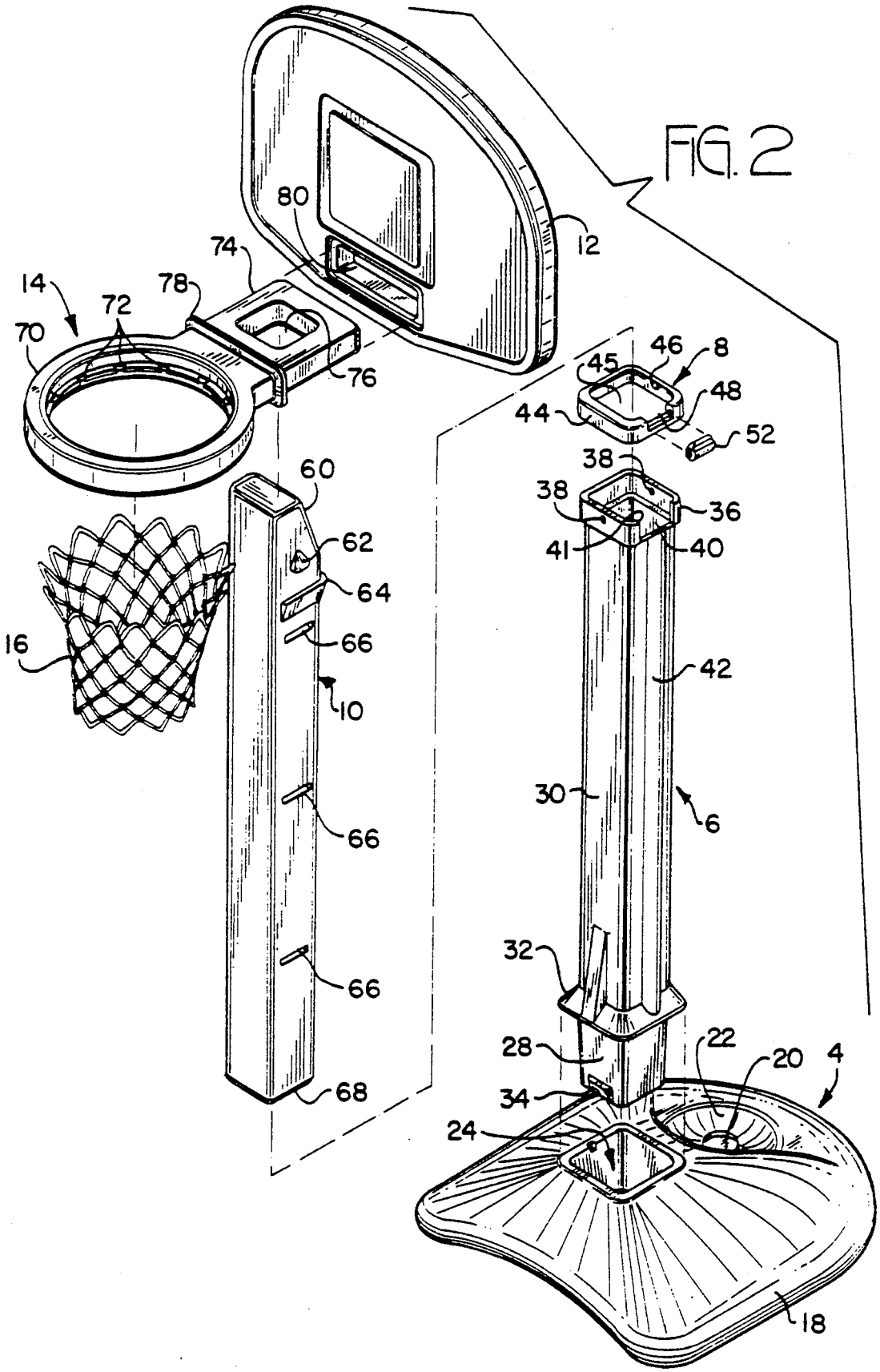
FIG. 2 is an exploded perspective view of the subject stand.

As shown in greater detail in FIG. 2, the base (4) comprises a hollow rotationally molded plastic body (18) which is formed of conventional plastic material such as polyethylene. The body (18) is adapted having a downwardly concave top surface. Located at a rearward end of the body (18) is an access aperture (20) which communicates with the interior of the hollow body (18), and through which sand can be introduced. The aperture (20) is situated in the middle of a depression (22) for directing sand into the interior of the body (18), whereby the body (18) can be stably counterbalanced by the sand.

Situated at the forward end of the body (18) is a through bore (24) of a square cross section which extends downward from a top surface of the body (18) to a bottom surface (26). As will best be seen from FIG. 3, the body (18) has a concave bottom (26) which defines, with the underlying floor, a cavity for a purpose explained below.

Referring back to FIG. 2, the lower post member (6) is adapted having a wedge-shaped lower end (28), and an elongate mid-section (30), separated from the wedge portion (28) by a downwardly directed peripheral flange (32) which extends the circumference of the post member (6). Molded-in retention lugs (34) are further provided to extend from a lower terminal end of the wedge-shaped portion (28), and are canted in an upward direction to enable the post member (6) to be inserted into the bore (24) of the stand base member.

An upper collar region (36) of the lower post member (6) is shown having a pair of assembly apertures (38) in opposite sides, and a rectilinear-shaped opening (40) in a third side. An axial bore (41) extends lengthwise through the lower post member (6) and the upper collar region (36). A longitudinally extending external rib (42) is provided along an outer wall of the lower post member (6), as shown, for structurally reinforcement of post (6).

Figure 5:
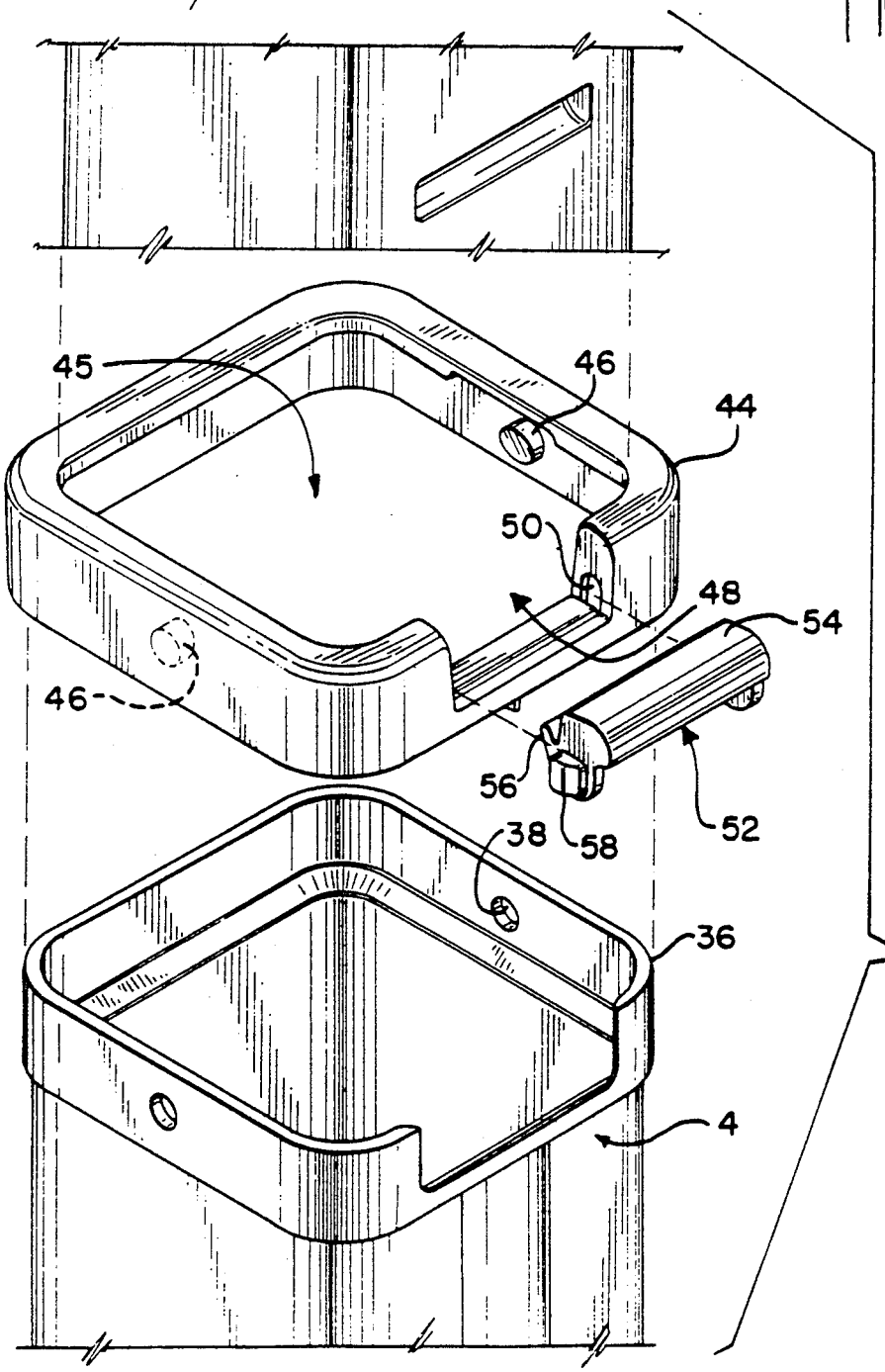

With continued reference to FIGS. 2 and 5, a latching collar (44) is provided having a center opening (45) of a square shape; the collar (44) being adapted to mount over the upper collar region (36) of the lower post member (6). Inwardly directed lugs (46) are positioned in opposite walls of the collar member (44) and are sized to snap into the assembly apertures (38) of the upper collar region (36), as shown best in FIG. 5. A rectilinear shaped opening (48) is provided in an outer wall of the collar member (44), dimensioned to align with the similarly shaped opening (40) of the collar region (36). Disposed in the opposite, inward facing walls of the collar member (44), which define the opening (48), are recesses (50).

With continued reference to FIGS. 2 and 5, a pivot latch member (52) is provided having a generally L-shaped, transverse sectional profile. The member (52) comprises a vertical segment (54) and a horizontal segment (56) which intersect forming an external acute angle. Outwardly directed pivot projections (58) extend from opposite sides of the vertical segment (54), and are adapted to reside within apertures (50) of the collar member (44). So disposed, the latch member (52) pivots about projections (58) from a generally vertical orientation (as shown in FIG. 5*a*) to a generally horizontal configuration (as shown in phantom by FIG. 5*a*). The horizontal portion (56) of the latch member (52) accordingly moves from a position which invades the central opening (45) of the collar member (44), to a secondary position which is outside of the collar opening (45).

Figure 4:
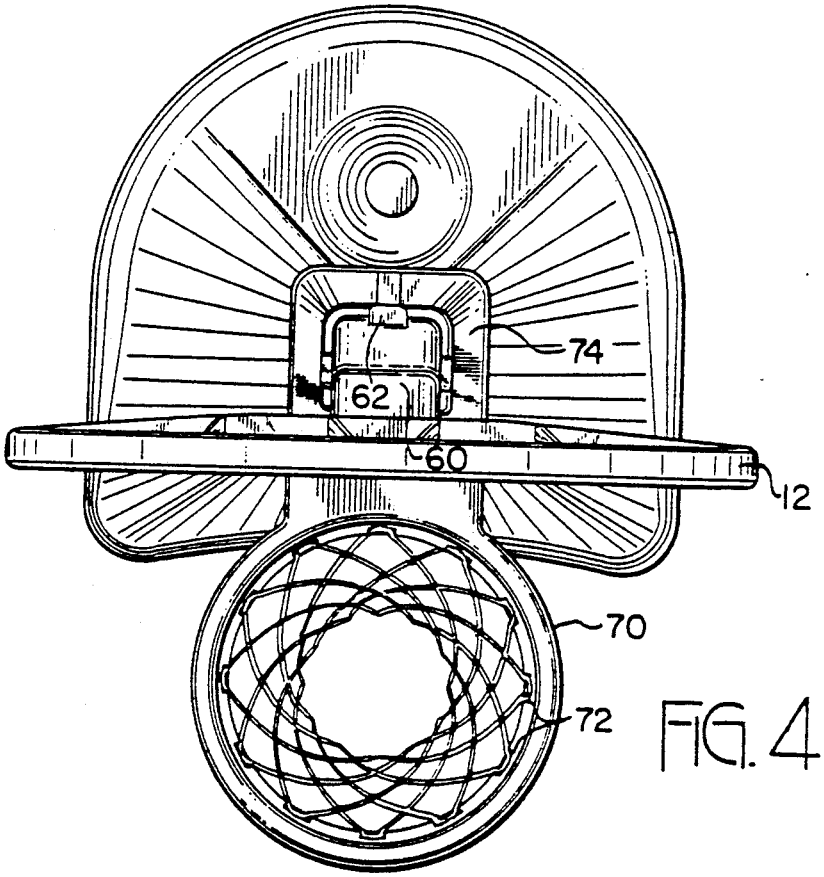
FIG. 4 is a top plan view of the subject basketball stand as assembled.

Referring next to FIGS. 2 and 4, the upper post (10) is adapted as having a wedged-shaped upper end (60), and three outwardly directed locking lugs (62) in outward surfaces of the wedge-shaped portion (60). A molded collar flange (64) is provided proximate to the wedge-shaped upper end (60). Rectilinear molded detents (66) are provided at specified locations along the outer surface of the upper post member (10), as shown in FIG. 2. It will be appreciated that the lower end (68), and the main body of the upper post (10) are dimensioned to telescope into the axial bore (41) of the lower post member (6) according to the present invention.

With further reference to FIGS. 2 and 4, the hoop component (14) is structured to provide a circular frame (70) at an outward end. A plurality of spaced hooks (72) are molded integrally into an inwardly directed surface of the circular frame (70). A neck portion (74) projects rearward from the circular frame (70), having a generally square configuration, and a square opening (76) extending therethrough. The neck portion (74) is separated from the circular frame (70) by an outwardly projecting peripheral flange (78). It will be appreciated from FIG. 2 that the neck portion (74) extends through a rectilinear shaped slot (80) in the backboard member (12), as shown. The peripheral flange (78) positions the hoop frame at its intended location, against the backboard (12).

With regard to FIG. 2, it will be appreciated that the components to the subject basketball stand are adapted to fit conveniently within a relatively small sized box for shipping and handling purposes. Further, it will be appreciated that no fasteners are necessary in the subject assembly, whereby facilitating a convenient assembly by the end user. Assembly of the subject invention proceeds as described below.

Figure 3:
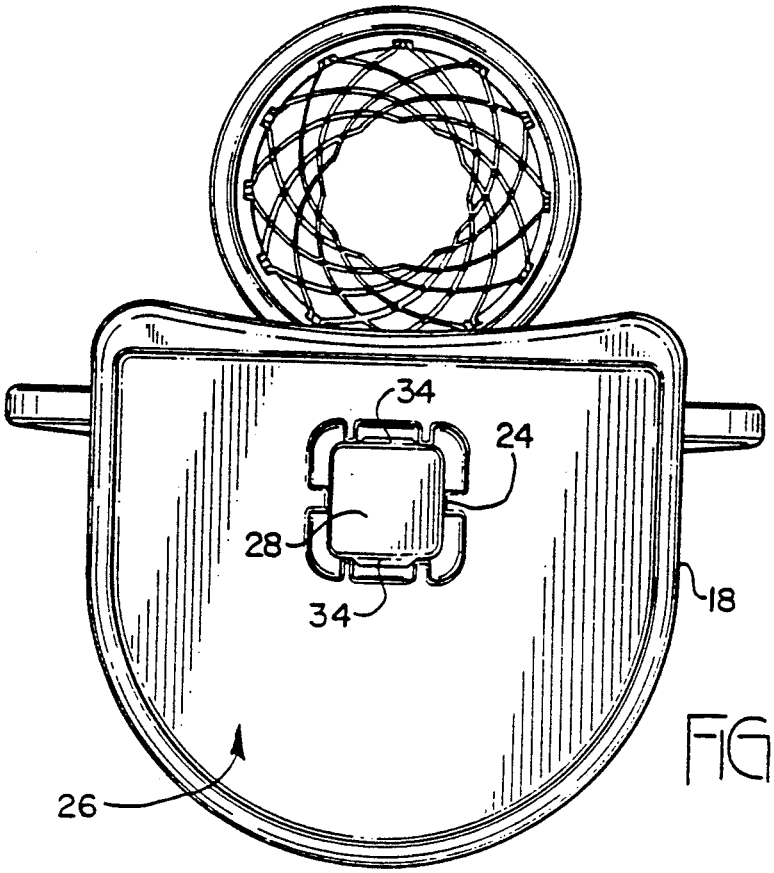
FIG. 3 is a bottom plan view of the subject basketball stand as assembled.

With continued reference to FIG. 2 and FIG. 3, the lower post member (6) is inserted into the bore (24) of the stand body (18) until locking lugs (34) snap over the bottom concave surface (26), as shown in FIG. 3. So inserted, the spacing flange (32) is situated against the base body (18), and the lower pole (6) is fixedly held in a vertical orientation relative to the stand (4). It will further be appreciated, from FIG. 3, that the bottom end of the lower post (6) is positioned above the ground by virtue of the cavity formed between the lower surface (26) and the underlying ground level.

As shown in FIGS. 2 and 5, the collar member (44) is mounted over the collar region (36) of the lower post (6), as detent lugs (46) snap into apertures (38). Thereafter, the latching member (52) is pivotally fixed within the opening (48) of the collar member (44), as outwardly directed detent lugs (58) snap into retention apertures (50). So mounted, the latching member (52) pivots from a first position (shown in FIG. 5*a*), to a second position (shown in phantom in FIG. 5*a*). When in the first position, the horizontal portion (56) of the latching member (52) extends inward to a sufficient extent to penetrate the axial bore extending through the collar region (44) and the lower post (6). When pivoted outward into the second position (shown in phantom in FIG. 5*a*), the horizontal portion (56) of the latching member (52) pivots out of the axial bore of the lower post (6).

With continued reference to FIGS. 1, 2, and 5, the lower end (68) of the upper post member (10) is inserted telescopically into the axial bore of the lower post (6), until a detent recess (66) is aligned with the latching member (52). The latching member (52), during repositionment of the upper post (10) within the axial bore (41), is in its outward second position (as shown in phantom in FIG. 5*a*). After appropriate alignment of a detent recess (66) with the latching member (52), the latching member (52) is pivoted upright (as shown in FIG. 5*a*)

and the horizontal portion (56) penetrates into the recess (66). The upper post member (10) is thereby held in fixed orientation relative to the lower post (6), and at a desired height. For readjustment of height, the latch member is pivoted outward (as shown in FIG. 5*a*), whereby freeing the horizontal portion (56) from the recess (66), and facilitating telescopic repositionment of the upper post member (10) within the lower post member (6).

Assembly continues with the following. The neck portion (74) of the hoop member (14) is inserted through the rectilinear slot (80) of the backboard (12), and over the wedge-shaped top (60) of the upper post (10) until situated between locking lugs (62) and the spacer flange (64). The lugs (62) snap over the top of the neck portion (74) to fixedly retain the neck portion (74) to the upper post member (10). The spacer flange (78), separating the neck portion (74) from the circular hoop frame (70), resides against the backboard (12). Thereafter, as will be appreciated, the net (16) is suspended from the hooks (72) in a manner conventional to basketball hoop stands.

The completely assembled stand is illustrated in FIGS. 1, 6, 7, and 8. As will be appreciated by those skilled in the art, the subject assembly described above can be accomplished without the use of tools. Further, the number of parts comprising the subject basketball stand is relatively small, minimizing the cost of manufacture. Further, it will be appreciated that all of the component parts (with the exception of the net member (16)), are composed of plastic material, molded in conventional fashion. The base is rotationally molded. The upper and lower posts, the hoop unit, and the backboard are blow molded, the latching mechanism is injection molded. So constructed the parts are durable, yet forgiving in the event that children inadvertently come in contact with the stand during play. Also, it will be appreciated from the above that the assembly procedure eliminates the need for fasteners. Assembly can be conveniently effected after the stand is purchased by the end user, yet the subject basketball stand can be packaged and sold in a knockdown version which is relatively compact.

Finally, it will be appreciated that the function of the latching mechanism is mechanically effective in keeping the relative height position between the upper and lower post members fixed. It will be appreciated (from FIGS. 5 and 5*a*) that the latch member (52) is shaped such that the horizontal leg (56) cannot inadvertently escape the recess (66) without a manual rotation of the latching body (52) away from the post members. Downward pressure on the upper post member only serves to pivot the vertical portion (54) against the outer wall of the post member, whereby further locking the latching mechanism (52) in place and inhibiting telescoping between the upper post members.

Convenience, cost savings, and ease of assembly achieved by the above described invention will be apparent to those skilled in the art. However, the principles described above have application beyond basketball stands. For example, any vertical post configuration in a toy which requires height adjustment can utilize the teachings herein set forth for latching mechanisms between telescoping parts. Accordingly, the teachings of the subject invention are not to be constrained to a basketball stand. Other applications, which will be apparent to those skilled in the art, using the teachings set forth herein are intended to be within the scope and spirit of the present invention.

I claim:

1. A basketball stand assembly, comprising:

a. a base;

b. a lower post attachable at a lower end to said base and having an axial bore extending downwardly therein from an upper end;

c. an upper post receivable in said lower post bore and extending upwardly therefrom;

d. backboard defining means having a profiled aperture extending therethrough;

e. net suspending means having a projecting member extending through said backboard profiled aperture and affixably receiving an upper end of said upper post therethrough, whereby fixedly attaching said backboard means and said net suspending means to said upper post.

2. An assembly according to claim 1 wherein said net suspending means comprising an outwardly disposed circular frame and an inwardly disposed neck section defining a profiled opening adapted for close receipt of said upper end of said upper post; and said upper end of said upper post having peripherally located detent lugs adapted to pass through said profiled opening and over said neck section to retain said net suspending means to said upper post.

3. An assembly according to claim 2, said detent lugs being profiled to pass through said profiled neck opening in an upward direction only.

4. An assembly according to claim 1, further comprising height adjustment means mounted to an upper end of said lower post and engaging a lower side of said upper post.

5. An assembly according to claim 4, said height adjustment means comprising a collar member mounted over said upper end of said lower post and a latching member pivotally mounted to said collar member and engaging said lower end of said upper post.

6. An assembly according to claim 5, said lower end of said upper post having spaced detents within an outer surface, said latching member comprising an inwardly directed latching flange receivable into one of said detents to fix the relative position of said upper and said lower posts.

7. An assembly according to claim 6, said latching member pivoting outward to release said upper post, whereby said upper post being telescopically repositionable within said lower post bore.

8. A basketball stand assembly, comprising:

a. a base;

b. a lower post attachable at a lower end to aid base and having an axial bore extending downwardly therein from an upper end;

c. an upper post receivable in said lower post bore and projecting upwardly therefrom;

d. height adjustment means attached to said upper end of said lower post and directed inwardly to engage said upper post, whereby said upper and lower posts being secured together;

e. backboard defining means having a profiled aperture extending therethrough;

f. net suspending means having a projecting member extending through said profiled aperture and affixing to an upper end of said upper post, whereby attaching said backboard defining means and said net suspending means to said upper post;

g. said hoop means comprising an outwardly disposed circular hoop frame and an inwardly disposed neck section defining a profiled opening adapted for close receipt of said upper end of said upper post; and said upper end of said upper post having peripherally located detent lugs adapted to pass through said profiled opening and over said neck section to retain said hoop means to said upper post.

9. An assembly according to claim 8, said lower end of said upper post having vertically spaced detents within an outer surface, said height adjustment means comprising an elongate, pivotally mounted latching member having an inwardly directed flange receivable into an alternate one of said detents to fix the relative position of said upper and said lower posts.

10. An assembly according to claim 9, said latching member pivotally releasing outwardly, whereupon said upper post being telescopically repositionable within said lower post bore.

* * * * *